US005481760A

United States Patent [19]

Wood, Jr.

[11] Patent Number: 5,481,760

[45] Date of Patent: Jan. 9, 1996

[54] CAP BLOCKER

[76] Inventor: William J. C. Wood, Jr., 4906 Salina St., Clinton, Md. 20735

[21] Appl. No.: 294,848

[22] Filed: Aug. 18, 1994

[51] Int. Cl.[6] ..... A42B 1/02

[52] U.S. Cl. ..... 2/195.5; 2/181.4; 2/181.6

[58] Field of Search ..... 2/171.1, 175.4, 2/181, 181.2, 181.4, 181.6, 182.1, 182.2, 182.3, 182.8, 195.5, 209.13; 223/24, 25, 84

[56] References Cited

U.S. PATENT DOCUMENTS

| | | | |
|---|---|---|---|
| 1,485,086 | 2/1924 | Mead . | |
| 1,495,895 | 5/1924 | Euster et al. | 2/181 |
| 1,562,990 | 11/1925 | Rappaport | 2/181 |
| 4,390,998 | 7/1983 | Gallin . | |
| 4,790,034 | 12/1988 | Pass | 2/195.5 |
| 4,858,247 | 8/1989 | Hooser . | |
| 5,012,531 | 5/1991 | Schoonover . | |
| 5,088,126 | 2/1992 | Mathis | 2/181.4 |
| 5,148,954 | 9/1992 | Myers . | |
| 5,161,719 | 11/1992 | Otteson et al. . | |

FOREIGN PATENT DOCUMENTS

| | | |
|---|---|---|
| 233290 | 5/1925 | United Kingdom . |
| 699022 | 10/1953 | United Kingdom . |
| 794735 | 5/1958 | United Kingdom . |

*Primary Examiner*—Diana Biefeld
*Attorney, Agent, or Firm*—Richard C. Litman

[57] ABSTRACT

A cap blocker provides for the maintenance of the shape of a billed, baseball type cap, particularly the shape of the front of the cap above the bill. The device is preferably formed of a flat, planar sheet of sturdy, relatively stiff material, which material allows at least some flexibility to adapt to the curvature of the band of a cap or the like. A vinyl plastic sheet material may be used, as well as other suitable materials. The cap blocker is inserted into the band of a cap, between the band and the outer cap material, where it extends upward into the front of the cap above the bill to prevent the collapse or deformation of that area of the cap. The blocker may also include relief areas along the upper edge, allowing the upper edge to be folded inward to accommodate the compound curvature of the top of the cap. Ventilation holes may also be provided for additional wearer comfort. The blocker may be inserted into existing caps, or caps may be provided with the blocker in place therein to preserve the new appearance of a cap.

14 Claims, 2 Drawing Sheets

CAP BLOCKER

FIELD OF THE INVENTION

The present invention relates generally to caps, hats, and headgear, and more specifically to a device which is installable within a cap to block the cap or preserve its shape while it is being worn.

BACKGROUND OF THE INVENTION

Billed caps which conform closely to the shape of the head, i.e., "baseball" caps, have become increasingly popular. Their protective attributes in addition to the eye shading provided by the bill, renders such caps exceedingly practical.

As such caps are worn as informal wear, rather than formally as many hats have been worn, they receive a relatively large amount of abuse, wear and tear. Many persons are proud of a particular hat which displays a particular emblem or insignia, and wish to show their affiliation with the related organization or to display their status according to the hat and emblem. For these persons, a worn or damaged cap is a disheartening experience, yet one that inevitably occurs in the course of wearing such a cap over a period of time.

The need arises for a device which may be inserted within a cap, which device maintains the original shape of the cap as it is being worn. The device may be provided with new caps, or alternatively may be provided separately for installation in existing caps. The device should provide for ventilation and other cap functions, while maintaining the utility of the cap and avoiding damage to an existing cap.

DESCRIPTION OF THE PRIOR ART

U.S. Pat. No. 1,485,086 issued to William H. Head on Feb. 26, 1924 discloses a Hat Form Holder constructed of wire, unlike the flat stock of the present invention, and provides for the maintenance of the shape of the crown of a brimmed felt hat. The Mead device does nothing for the shape of the front of the hat, unlike the present invention.

U.S. Pat. No. 4,390,998 issued to Paul G. Gallin on Jul. 5, 1983 discloses a Prefabricated Cap Frame formed of synthetic resin essentially comprising a band extending continuously around the band of the cap and having a thickened upper edge for reinforcement. A central portion extends vertically upward to support the top of the cap. The thickened upper edge of the band, discontinuous shade of the upper edge, continuous band, and relatively sharp edges, render the device unlike the present cap blocking device, which includes features specifically for billed, baseball type caps.

U.S. Pat. No. 4,858,247 issued to Donald L. Hooser on Aug. 22, 1989 discloses Cap Shape Supports comprising two interlocked planar sheets of material installable in a cap to hold its shape while drying after washing. The device forms a continuous band around the band of the cap, unlike the present invention, and the two interlocking components and relatively sharp corners of the device are unlike the structure of the present cap blocker.

U.S. Pat. No. 5,012,531 issued to Richard L. Schoonover on May 7, 1991 discloses a Form Retaining Holder For Visored Cap which encases a cap in a folded condition, i.e., with the back of the cap tucked into the forward part of the cap. A cap contained within the Schoonover holder cannot be worn, as the cap must be folded for insertion in the holder.

The Schoonover holder is not formed of a single sheet of flat material, as is the present cap blocker.

U.S. Pat. No. 5,148,954 issued to Clifford J. Myers on Sep. 22, 1992 discloses an Adjustable Cap Shaper having a base component which fits completely around the interior of the cap, and is held together at the top by a crown portion. The device is intended for shaping the cap after laundering, and is not suitable for use while the cap is being worn, as in the present cap blocker.

U.S. Pat. No. 5,161,719 issued to Tommy R. Otteson et al. on Nov. 10, 1992 discloses a Device For Supporting And Shaping Pliable Ball Caps comprising a wire frame covered with a mesh material. The frame supports the mesh and also grips the bill of the cap to hold the device in place in the cap. The device is intended to hold the shape of a cap after laundering, and cannot be worn with the cap due to the bulk of the wire frame and mesh within the cap.

British Patent No. 233,290 to Thornley & Booth Ltd. and accepted on May 7, 1925 discloses Improvements In Bandeaux comprising a strip of material having a Z-shaped cross section, which is stitched or otherwise permanently secured within a hat to adjust the fit of the band to the wearer. The device does nothing to maintain the shape of the hat, as does the present cap blocker.

British Patent No. 699,022 to Stanley P. Pickering and published on Oct. 28, 1953 discloses Improvements In Or Relating To Hats comprising a band insert of soft, pliable foam material. The hat must be modified by perforating the band for the foam insert to access therethrough, whereas the present invention requires no modifications to the cap to which it is applied. The soft and pliable Pickering band insert is by definition unable to maintain the shape of a hat, due to its pliable nature.

Finally, British Patent No. 794,735 to Moss Chaytow and published on May 7, 1958 discloses Improvements In Caps And Like Headwear comprising a method of adhesively securing the top of a cap lining within a cap. The lining is described as being a relatively soft, flexible and comfortable material, which by definition is incapable of maintaining the shape of the cap.

None of the above noted patents, taken either singly or in combination, are seen to disclose the specific arrangement of concepts disclosed by the present invention.

SUMMARY OF THE INVENTION

By the present invention, an improved cap blocker is disclosed.

Accordingly, one of the objects of the present invention is to provide an improved cap blocker which serves to preserve the original and/or desired shape of a billed cap (e.g., baseball cap) or the like while being worn.

Another of the objects of the present invention is to provide an improved cap blocker which is formed of a single sheet of relatively stiff yet flexible, pliable, and resilient material, devoid of protrusions from the plane of the sheet.

Yet another of the objects of the present invention is to provide an improved cap blocker which may be formed of clear plastic sheet material, such as vinyl, or other suitable materials.

Still another of the objects of the present invention is to provide an improved cap blocker which includes means for conforming to the compound curvature normally found at the upper front of such caps.

A further object of the present invention is to provide an improved cap blocker which is devoid of sharp corners, thereby precluding potential damage to the cap material from within the cap.

An additional object of the present invention is to provide an improved cap blocker which may include a plurality of ventilation holes therethrough.

Another object of the present invention is to provide an improved cap blocker which is adapted to be worn within the cap while the cap is being worn.

Yet another object of the present invention is to provide an improved billed cap which includes a cap blocker of the present invention therein.

A final object of the present invention is to provide an improved cap blocker for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the figures of the attached drawings.

DETAILED DESCRIPTION OF THE PREFERRED EMBODIMENTS

Figure 1:
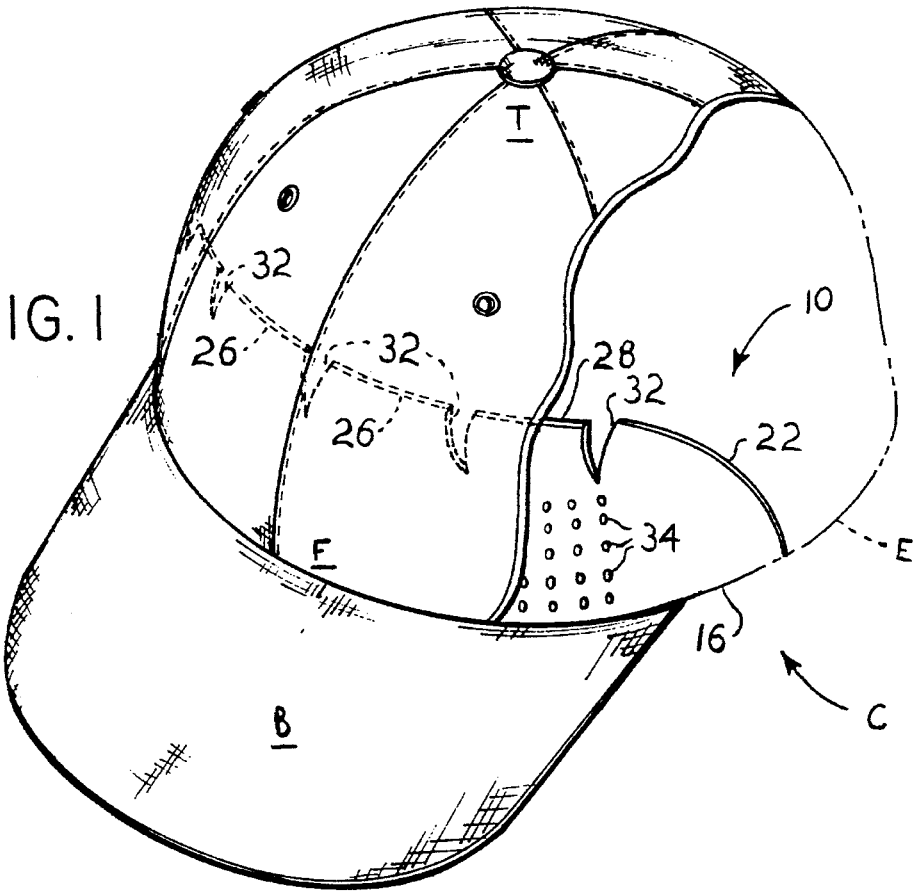
FIG. 1 is a perspective view in section of a billed, baseball type cap showing a cap blocker of the present invention installed therein.

Referring now to the drawings, the present invention will be seen to relate to a cap blocker 10 which is installable within the front of a billed cap C having a generally spherical crown (i.e., baseball cap or the like) and providing for the maintenance of the shape of the forward portion of the cap above the bill. The cap blocker 10 is formed of a single sheet of relatively thin, flexible resilient, and moisture repellent material, preferably a clear or at least translucent plastic material. It has been found that a thickness on the order of 0.15 inch, or approximately 1/64 inch, works well with a vinyl plastic sheet material, providing the desired flexibility to conform to the shape of the cap band while simultaneously providing sufficient rigidity to maintain the shape of the front of the cap C normal to the band.

Figure 3:
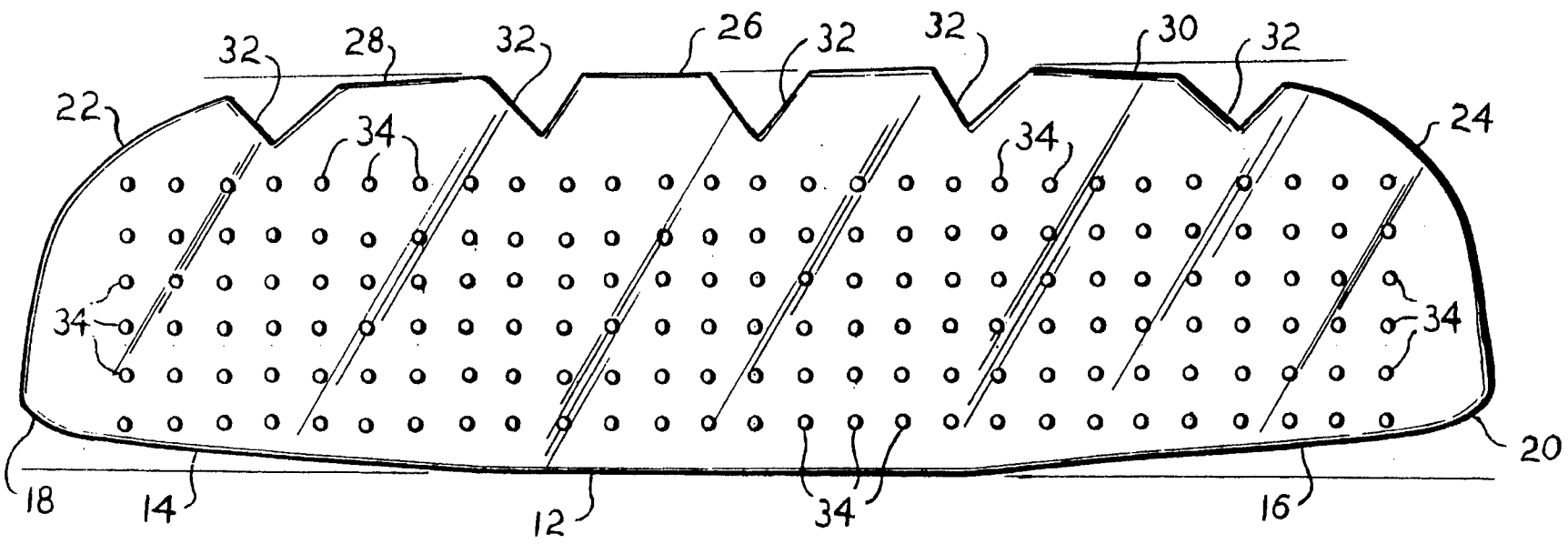
FIG. 3 is a plan view of the present cap blocker in its flat, planar uninstalled state.

FIG. 3 provides a plan view of the present cap blocker 10 as it would appear in a flat layout, and discloses the various structural details of the cap blocker 10 which provide for its function in blocking the front of a cap C.

Figure 2:
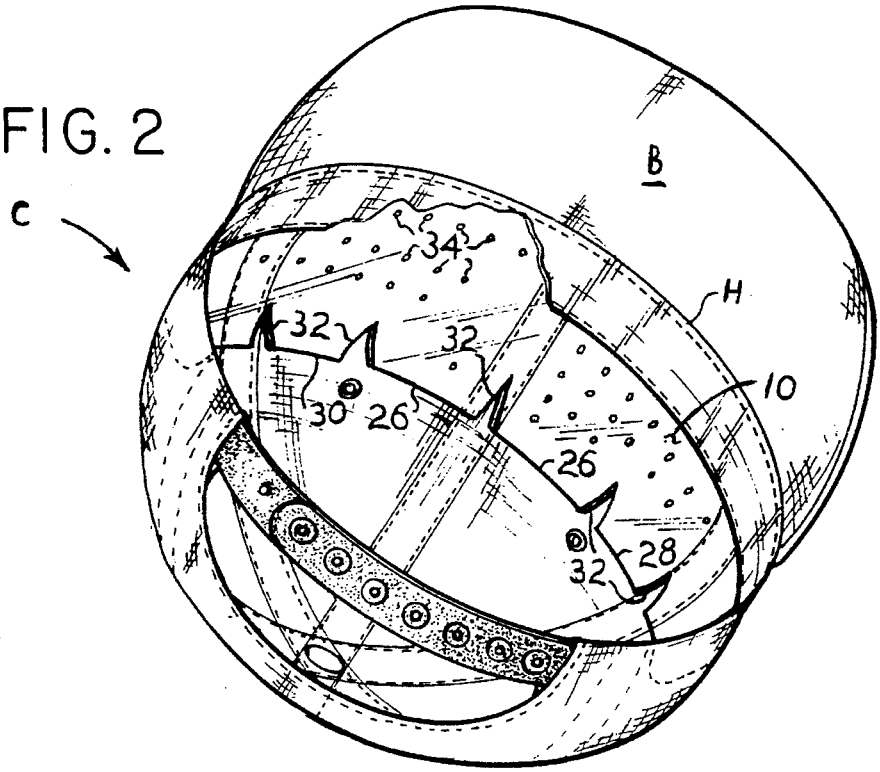
FIG. 2 is an inverted perspective view, showing the installation of the present cap blocker within the band of the cap.

The central lower edge 12 will be seen to form a straight edge, with the left and right lower edge portions 14 and 16 departing from the edge defined by the central lower edge 12 and having a slight upward taper. This upward taper of the outermost lower edge portions 14 and 16 of the cap blocker 10 provides close conformity with the shape of most baseball type caps C. Generally, such caps C do not have a true cylindrical shape at their lower edges when expanded for wearing, but rather the shape is a slightly tapered, conical shape provided by the plural gores of the cap, with the gores or panels having an increasing amount of taper toward the apex to provide a shape generally approximating a hemisphere when the cap shape is filled out. Thus, when the cap blocker 10 is formed into a curved shape to fit within the headband H of a cap C, as shown in FIGS. 1 and 2, the tapered lower edge portions will fit downward into the space between the headband H and the lower edge E of the cap C, and allow the cap blocker 10 to be tipped back slightly to conform to the shape of the cap C as defined by the gores of the cap C.

It will be noted further that each of the lower ends 18 and 20 of the cap blocker 10 are rounded or curved, in order to preclude sharp corners which might otherwise damage the fabric or material of the Cap C into which the blocker 10 is installed. The corresponding upper ends 22 and 24 are also curved, having a larger radius of curvature than the lower ends 18 and 20, in order to preclude damage to the relatively lighter weight material of the upper portion of the cap C, in comparison to the relatively heavier and more durable multiple plies of the headband H and lower edge E of the cap C.

The upper edge portion of the blocker 10 is configured somewhat along the lines of the lower edge portions discussed above. The central upper edge 26 is parallel to the central lower edge 12, while the left and right upper edge portions 28 and 30 are each slightly tapered in order to preclude distending the upper portions of the cap C to each side of the center area.

As the present cap blocker 10 is inserted into the headband H of a cap C, it will form a generally cylindrical or conical section across its transverse axis (i.e., parallel to the lower and upper central edges 12 and 26), due to its flexible nature. Due to the curved configuration of the cap blocker 10 when it is installed within a cap C, the device will resist bending in a direction normal to its curvature, in the nature of cylindrical and channel sections of material. Depending upon the height of the cap blocker 10, this bending resistance could distend the upper portion of a cap C and produce an improper shape for the front portion of the cap. Accordingly, a plurality of reliefs 32 are provided along the upper edge portions 26 through 30 of the cap blocker 10. These reliefs may be in the form of V-shaped cutouts, as depicted; other shapes (e.g., U-shaped) may be used, as desired. The relatively small angular curvature between each of these reliefs 32 allows the upper edge portions 26 through 30 between the relief cutouts 32 to flex inward beneath the upper portion of the front of the cap C, thereby simulating the generally compound curvature of the upper portion of a cap C. The resilient nature of the cap blocker 10 also results in the upper edge portions 26 through 30 being biased against the inside of the cap C, whereby the adjacent cap material is urged upward and forward by the upper edge portions 26 through 30 of the cap blocker 10 to maintain the proper shape.

In addition to the above features, a plurality of ventilation holes 34 may be provided for additional comfort for the wearer of a cap C equipped with the present cap blocker 10, and to provide for the evaporation of perspiration from a cap C wearer.

The present cap blocker 10 is installed within a cap C by placing the lower edge portions 12 through 16 between the headband H and the front F of the cap C immediately behind the bill B, as shown in FIGS. 1 and 2. The flexible nature of the sheet material from which the cap blocker 10 is formed, allows the cap blocker 10 to curve transversely around the inner surface of the front F of the cap C, with the lower edge portions 12 through 16 contained between the headband H and the lower portion of the cap C. Thus, the wearer's head is not in contact with the relatively hard material of the cap blocker 10, but only with the inner surface of the headband H, in order to assure the comfort of the wearer. Further comfort is provided by the ventilation holes 34.

The upper edge 26 through 30 of the cap blocker 10 may extend upward within the cap C, to distend the upper portion of the cap C. The reliefs 32 preclude such distension, as disclosed above, by providing for the inward flexure of the upper edge portions 26 through 30 as the front F of the cap C extends upward and rearward to the topmost portion T. The V-shaped reliefs 32 are urged together, as shown in FIGS. 1 and 2, to allow the upper edge portions 26 through 30 of the cap blocker 10 to fold inward around the generally curved cap blocker 10, and to urge the front F of the cap C outward to block and maintain its shape as desired.

The cap blocker 10 may be formed in any convenient length, i.e., of substantially equal width to the bill B of the cap C, but is preferably of sufficient length to extend around substantially one half of the inner periphery of the cap C, as shown in FIG. 1. Alternatively, the cap blocker 10 may be provided in a somewhat longer length, extending around over one half of the inner periphery of the cap C, as shown in FIG. 2 in order to provide a blocking effect for a larger area of the cap C. Typically, such caps C are formed with a series of six gores or panels, with a corresponding number of seams therebetween. By extending the cap blocker 10 around to the seam to either side of the back center of the cap C, an arcuate peripheral coverage of some 240 degrees, or two thirds of the cap C periphery, may be obtained. Shorter or longer cap blockers 10 may be provided as desired.

The present cap blocker 10 will be seen to provide for the maintenance of the shape of the front F of a cap C over a long period of use, due to its resilient and moisture resistant nature. The present cap blocker 10 may be installed in a cap C for continuous use, with provision for removal for laundering the cap C as desired. The cap blocker 10 is not in contact with the head or scalp of the wearer of a cap C so equipped, thus insuring the comfort of the wearer. Alternatively, caps C may be provided with a cap blocker 10 already installed, to provide the wearer of such a cap C with a durable, long lasting cap C which will continue to hold its shape and appearance over an extended period of wear and use.

It is to be understood that the present invention is not limited to the sole embodiments described above, but encompasses any and all embodiments within the scope of the following claims.

I claim:

1. A cap blocker comprising:

a single planar sheet of flexible, resilient material having central, left and right lower edge portions, corresponding central, left and right upper edge portions, and left and right curved lower end portions and left and right curved upper end portions, said upper end portions having a larger radius of curvature than said lower end portions;

said cap blocker being adapted for installation within the front portion of a billed cap and extending upward therein to preclude the deformation thereof, with said lower edge portions of said cap blocker being adapted for insertion between the outer material and the underlying head band of the billed cap and retained therein while the cap is worn by a wearer thereof, whereby;

said cap blocker is installed within the billed cap to provide for the continuous blocking of the front portion of the cap and to preclude any deformation of the front portion of the cap while the cap is being worn.

2. The cap blocker of claim 1 wherein:

at least said left and right lower edge portions are tapered upwardly with respect to said central lower edge portion.

3. The cap blocker of claim 1 wherein:

at least said left and right upper edge portions are tapered downwardly with respect to said central upper edge portion.

4. The cap blocker of claim 1 wherein:

said central, left and right upper edge portions include a plurality of reliefs formed therealong, whereby;

said upper edge portions are curved rearwardly and resiliently urged against the inner front surface of the cap when said cap blocker is installed therein, with said reliefs providing for the mutual lateral curvature of said cap blocker and curvature of said upper edge portions normal to the lateral curvature when said cap blocker is installed within the cap.

5. The cap blocker of claim 4 wherein:

said reliefs comprise a plurality of V-shaped cutouts.

6. The cap blocker of claim 1 including:

ventilation holes disposed substantially entirely across said cap blocker.

7. The cap blocker of claim 1 wherein:

said cap blocker is formed of a translucent and moisture repellent plastic material.

8. In combination with a cap having an outer layer of material, a front portion having an inner surface and including a bill extending therefrom and an underlaying inner peripheral head band within said outer layer of material, a cap blocker comprising:

a single planar sheet of flexible, resilient material having central, left and right lower edge portions, corresponding central, left and right upper edge portions, and left and right curved lower end portions and left and right curved upper end portions, said upper end portions having a larger radius of curvature than said lower end portions;

said cap blocker being installed within the front portion of said cap and extending upward therein to preclude the deformation thereof, with said lower edge portions of said cap blocker being inserted between said outer layer of material and said underlying head band and retained therein while said cap is worn by a wearer thereof, whereby;

said cap blocker provides for the continuous blocking of said front portion of said cap and further precludes any deformation of said front portion of said cap while said cap is being worn.

9. The combination cap and cap blocker of claim 8 wherein:

at least said left and right lower edge portions of said cap blocker are tapered upwardly with respect to said central lower edge portion of said cap blocker.

10. The combination cap and cap blocker of claim 8 wherein:

at least said left and right upper edge portions of said cap blocker are tapered downwardly with respect to said central upper edge portion of said cap blocker.

11. The combination cap and cap blocker of claim 8 wherein:

said central, left and right upper edge portions of said cap blocker include a plurality of reliefs formed therealong, whereby;

said upper edge portions of said cap blocker are curved rearwardly and resiliently urged against said inner front surface of said cap, with said reliefs providing for the mutual lateral curvature of said cap blocker and curvature of said upper edge portions normal to the lateral curvature.

12. The combination cap and cap blocker of claim 11 wherein:

said reliefs of said cap blocker comprise a plurality of V-shaped cutouts.

13. The combination cap and cap blocker of claim 8 including:

ventilation holes disposed substantially entirely across said cap blocker.

14. The combination cap and cap blocker of claim 8 wherein:

said can blocker is formed of a translucent and moisture repellent plastic material.

* * * * *